US008053614B2

(12) United States Patent
Aalto et al.

(10) Patent No.: US 8,053,614 B2
(45) **Date of Patent: *Nov. 8, 2011**

(54) BASE OIL

(75) Inventors: Pekka Aalto, Porvoo (FI); Juha Moilanen, Porvoo (FI); Janne Jokinen, Espoo (FI); Eija Koivusalmi, Kulloonkylä (FI); Jukka Myllyoja, Vantaa (FI); Juha Jakkula, Kerava (FI); Vesa Niemi, Porvoo (FI)

(73) Assignee: Neste Oil OYJ, Espoo (FI)

( * ) Notice: Subject to any disclaimer, the term of this patent is extended or adjusted under 35 U.S.C. 154(b) by 387 days.

This patent is subject to a terminal disclaimer.

(21) Appl. No.: 11/637,107

(22) Filed: Dec. 12, 2006

(65) Prior Publication Data

US 2007/0135663 A1 Jun. 14, 2007

Related U.S. Application Data

(60) Provisional application No. 60/749,037, filed on Dec. 12, 2005.

(51) Int. Cl.
*C10M 105/04* (2006.01)

(52) U.S. Cl. ..... 585/1; 585/16; 585/240; 208/18

(58) Field of Classification Search ..... 508/365, 508/391; 585/739, 16, 1, 240; 208/19, 108, 208/180, 18

See application file for complete search history.

(56) References Cited

U.S. PATENT DOCUMENTS

| | | | | |
|---|---|---|---|---|
| 3,182,017 A | | 5/1965 | Fleck et al. | |
| 3,242,080 A | * | 3/1966 | Wiley et al. | 508/391 |
| 3,444,143 A | | 5/1969 | Morris et al. | |
| 3,501,546 A | | 3/1970 | Dubeck et al. | |
| 4,026,960 A | * | 5/1977 | Nishida et al. | 585/16 |
| 4,133,841 A | | 1/1979 | Cosyns et al. | |
| 4,299,979 A | | 11/1981 | Murphy | |
| 4,317,948 A | | 3/1982 | Heckelsberg | |
| 4,457,944 A | | 7/1984 | Conrad et al. | |
| 4,744,884 A | | 5/1988 | Moorehead et al. | |
| 4,783,274 A | | 11/1988 | Jokinen et al. | |
| 5,333,698 A | | 8/1994 | Van Slyke | |
| 5,416,239 A | | 5/1995 | Westfechtel et al. | |
| 5,444,170 A | | 8/1995 | Vedage | |
| 5,516,960 A | | 5/1996 | Robinson | |
| 5,705,722 A | | 1/1998 | Monnier et al. | |

(Continued)

FOREIGN PATENT DOCUMENTS

DE 1024238 B 2/1958

(Continued)

OTHER PUBLICATIONS

"Scope of Accreditation for Testing" 2009.*

(Continued)

*Primary Examiner* — Ellen McAvoy
*Assistant Examiner* — Chantel Graham
(74) *Attorney, Agent, or Firm* — Birch, Stewart, Kolasch and Birch, LLP

(57) ABSTRACT

The invention relates to a new base stock material. Specifically the invention relates to a saturated hydrocarbon composition and particularly to a composition based on biological raw materials, to be used as a high-quality base oil or to be used as a component in the production of a base oil having a high viscosity index and good low temperature properties. The composition contains saturated hydrocarbons and has a narrow carbon number range.

27 Claims, 1 Drawing Sheet

U.S. PATENT DOCUMENTS

| | | | | |
|---|---|---|---|---|
| 5,719,097 | A | 2/1998 | Chang et al. | |
| 6,245,725 | B1 * | 6/2001 | Tanaka et al. | 508/365 |
| 6,562,230 | B1 | 5/2003 | O'Rear et al. | |
| 6,599,864 | B1 | 7/2003 | Bertomeu | |
| 6,683,224 | B1 | 1/2004 | Hourticolon et al. | |
| 6,703,356 | B1 | 3/2004 | Wu | |
| 2002/0062055 | A1 * | 5/2002 | Raulo et al. | 585/739 |
| 2003/0181769 | A1 | 9/2003 | Both et al. | |
| 2004/0002620 | A1 | 1/2004 | Schwerin et al. | |
| 2004/0053796 | A1 | 3/2004 | O'Rear | |
| 2004/0055209 | A1 | 3/2004 | Jakkula et al. | |
| 2004/0099571 | A1 * | 5/2004 | Germaine et al. | 208/108 |
| 2004/0230085 | A1 | 11/2004 | Jakkula et al. | |
| 2005/0077209 | A1 | 4/2005 | Miller et al. | |
| 2005/0133408 | A1 | 6/2005 | Abernathy et al. | |
| 2005/0241990 | A1 * | 11/2005 | Ziemer et al. | 208/19 |
| 2006/0027486 | A1 * | 2/2006 | Rosenbaum et al. | 208/180 |

FOREIGN PATENT DOCUMENTS

| | | | |
|---|---|---|---|
| DE | 33407111 | | 10/1983 |
| EP | 0 209 997 | | 1/1987 |
| EP | 0239320 | | 9/1987 |
| EP | 0 457 665 | A1 | 11/1991 |
| EP | 0 591 297 | A1 | 4/1994 |
| EP | 0 774 451 | A1 | 5/1997 |
| EP | 1396531 | A2 | 3/2004 |
| EP | 1681337 | A1 | 7/2006 |
| FI | 66899 | | 8/1984 |
| FI | 100248 | B | 2/1996 |
| FR | 579 601 | A | 10/1924 |
| GB | 175974 | A | 6/1923 |
| GB | 1193220 | A | 5/1970 |
| GB | 1524781 | * | 1/1977 |
| GB | 1 524 761 | | 9/1978 |
| JP | 59108008 | A | 6/1984 |
| JP | 01056792 | A | 3/1989 |
| WO | WO-93/00320 | A1 | 1/1993 |
| WO | WO-96/17902 | A1 | 6/1996 |
| WO | WO-2004/062763 | A2 | 7/2004 |

OTHER PUBLICATIONS

Fette, Seifen, Anstrichmittel, vol. 82, No. 11, 1980, U.-A. Schaper, Die gemischte Guerbet-Reaktion zwischen cyclischen und acyclischen Alkoholen, 454-456.

Burg, et al., JOACS, (1991), vol. 68, (8), pp. 600-603.

Cui, S.T., et al., "Nonequlibrium Molecular Dynamics Simulation of the Rheology of Linear and Branched Alkanes", International Journal of Thermophysics, 1988, vol. 19, No. 2, pp. 449-459.

English translation of Finnish Patent Office Search Report for Finnish Patent Application No. FI-200556665.

Kirk-Othmer, Encyclopedia of Chemical Technology, 3rd ed., (1980), vol. 7, Wiley, p. 768.

Kirk-Othmer, Encyclopedia of Chemical Technology, 3rd ed., (1980), vol. 9, Wiley, p. 370.

Koster, R.M., et al., Active sites in the clay catalysed dimerisation of oleic acid, Journal of Molecular Catalysis A: Chemical, (1998), vol. 134, pp. 159-169.

Maier, W.F. et al., Gas Phase Decarboxylation of Carboxylic Acids, Chem. Ber., (1982), vol. 115, pp. 808-812.

Morrison, R.T. and Boyd , R. N., Organic Chemistry, 5th ed. (1987), Allyn and Bacon, Newton, Massachusetts, pp. 94, 640, 679-680, 913-914.

Notification of Transmittal of the International Search Report and Written Opinion of the International Searching Authority for PCT/FI2006/050553.

PCT Notification of Transmittal of the International Search Report and the Written Opinion of the International Searching Authority or the Declaration of Application No. FI-2005050550.

Ulmanns, Encykolpadie der technischen Chemie, 4., neubearbeitete und erweiterte Auflage, Band 13, (1976), Verlag Chemie GmbH, Weinheim, p. 146.

Ullmanns Encyklopadie der technischen Chemie, 4., neubearbeitete und erweiterte Auflage, Band 13, Verlag Chemie GmbH, Weinheim 1983, Hydrierung p. 140.

Klimkiewicz et al., "Ketonization of long chain esters from transesterification of technical waste fats", J. Chem. Technol. Biotechnol. vol. 76, 2001, pp. 35-38.

Laurent, E., et al., Study of the hydrodeoxygenation of carbonyl, carboxylic and guaiacyl groups over sulfided CoMo/$\gamma$-$Al_2O_3$ and NiMo/$\gamma$-$Al_2O_3$ catalyst. II. Influence of Water, ammonia and hydrogen sulfide, Applied Catalysis A, (1994), vol. 109. pp. 97-115.

Laurent, E., et al., Study of hydrodeoxygenation of carbonyl, carboxylic and guaiacyl groups over sulfided CoMo/$\gamma$-$Al_2O_3$ and NiMo/$\gamma$-$Al_2O_3$ catalyst. I. Catalytic reaction schemes, Applied Catalysis A, (1994), vol. 109, pp. 77-96.

Search report from PCT/FI2006/050548.

Translation of Search Report of FI-20055661 dated May 12, 2006.

Office Action issued in U.S. Appl. No. 11/636,567 on Jan. 27, 2009.

Office Action issued in U.S. Appl. No. 11/636,567 on Aug. 18, 2009.

Office Action issued in U.S. Appl. No. 11/636,567 on Dec. 15, 2009.

Office Action issued in U.S. Appl. No. 11/637,139 on Apr. 6, 2009.

Office Action issued in U.S. Appl. No. 11/637,139 on Dec. 31, 2009.

Office Action issued in U.S. Appl. No. 11/637,159 on Mar. 11, 2010.

"Scope of Accreditation for Testing" Thai Laboratory Accreditation Scheme, Thai Industrial Standards Industry, Ministry of Industry, Issue No. 9, Sep. 25, 2009.

Search report from PCT/FI2006/050548 dated Apr. 12, 2007.

Office Action dated Aug. 6, 2010 issued in U.S. Appl. No. 11/636,567.

Office Action dated Apr. 26, 2010 issued in U.S. Appl. No. 11/637,139.

Office Action dated Aug. 25, 2010 issued in U.S. Appl. No. 12/433,394.

Office Action issued in U.S. Appl. No. 11/637,139 on Jan. 23, 2009.

Office Action issues in U.S. Appl. No. 11/637,159 on Jul. 1, 2010.

Office Action issued in U.S. Appl. No. 11/637,159 on Nov. 19, 2009.

U.S. Notice of Allowance dated Apr. 8, 2011 issued in U.S. Appl. No. 11/636,567.

Office Action issued in U.S. Appl. No. 11/637,159 on Aug. 19, 2010.

U.S. Notice of Allowance dated Jul. 1, 2010 issued in U.S. Appl. No. 11/637,159.

U.S. Notice of Allowance dated Aug. 13, 2010 issued in U.S. Appl. No. 11/637,139.

U.S. Notice of Allowance dated Sep. 30, 2010 issued in U.S. Appl. No. 11/637,159.

U.S. Notice of Allowance dated Feb. 23, 2011 issued in U.S. Appl. No. 12/433,394.

* cited by examiner

BASE OIL

This Nonprovisional application claims priority under 35 U.S.C. §119(e) on U.S. Provisional Application No. 60/749,037 filed on Dec. 12, 2005, the entire contents of which are hereby incorporated by reference.

TECHNICAL FIELD

The invention relates to a new base stock material. Specifically the invention relates to a branched saturated hydrocarbon composition and particularly to a composition based on biological raw materials, suitable for use as a high-quality base oil or to be used as a component in the production of a base oil having a high viscosity index and good low temperature properties. The composition contains branched saturated hydrocarbons and it has a narrow carbon number range.

STATE OF THE ART

Base oils are commonly used for the production of lubricants, such as lubricating oils for automotives, industrial lubricants and lubricating greases. They are also used as process oils, white oils and metal working oils. Finished lubricants consist of two general parts, lubricating base oils and additives. Base oils are the major constituents in finished lubricants and they contribute significantly to the properties of the finished lubricant. In general, a few base oils are used to manufacture a wide variety of finished lubricants by varying the mixtures of individual base oils and individual additives. The American Petroleum Institute (API) base oils classification is shown in Table 1. Today, API Group III and IV base oils are used in high-quality lubricants.

TABLE 1

API base oil classification

| Group | Saturated hydrocarbons wt-% (ASTM D 2007) | Sulfur, wt-% (ASTM D 1552/ D 2622/D 3120/ D 4294/D 4927) | Viscosity index (VI) (ASTM D 2270) |
|---|---|---|---|
| I | <90 and/or | >0.03 | 80 ≦ VI < 120 |
| II | ≧90 | ≦0.03 | 80 ≦ VI < 120 |
| III | ≧90 | ≦0.03 | ≧120 |
| IV | All polyalphaolefins (PAO) | | |
| V | All other base oils not belonging to Groups I–IV | | |

Oils of the Group III are base oils with very high viscosity indices (VHVI) produced by modern methods from crude oil by hydrocracking, followed by isomerization of the waxy linear paraffins to give branched paraffins. Oils of Group III also include base oils produced from Slack Wax (SW) paraffins from mineral oils. Future products, not yet available, made from waxes (GTL waxes) obtained by Fischer-Tropsch (FT) synthesis for instance from coal or natural gas using corresponding isomerization techniques may in future belong in this group as well. Oils of Group IV are synthetic polyalphaolefins (PAO). Ester base oils belonging in Group V are produced from fatty acids and alcohols. Said fatty acids are either natural or synthetic mono or dicarboxylic acids. Depending on the ester to be produced, the alcohol is a polyol or a monohydroxylic alcohol. Ester base oils are typically monoesters, diesters, polyol esters or dimer esters. A similar classification is also used by ATIEL (Association Technique de l'Industrie Européenne des Lubrifiants, or Technical Association of the European Lubricants Industry), said classification also comprising Group VI: Polyinternalolefins (PIO). In addition to the official classification, also Group II+ is commonly used in this field, this group comprising saturated and sulfur-free base oils having viscosity indices of more than 110, but below 120. In these classifications saturated hydrocarbons include paraffinic and naphthenic compounds, but not aromatics.

There is also available a definition for base oils (base stocks) according to API 1509 as: "A base stock is a lubricant component that is produced by a single manufacturer to the same specifications (independent of feed source or manufacturer's location); that meets the same manufacturer's specification; and that is identified by a unique formula, product identification number, or both. Base stocks may be manufactured using a variety of different processes." Base oil is the base stock or blend of base stocks used in API-licensed oil. The base stock types are 1) Mineral oil (paraffinic, naphthenic, aromatic), 2) Synthetic (polyalphaolefins, alkylated aromatics, diesters, polyol esters, polyalkylene glycols, phosphate esters, silicones), and 3) Plant oil.

Already for a long time, especially the automotive industry has required lubricants and thus base oils with improved technical properties. Increasingly, the specifications for finished top-tier lubricants require products with excellent low temperature properties and low volatility together with right viscosity level. Generally top-tier lubricating base oils are base oils having a kinematic viscosity of about 3 cSt or greater at 100° C. (KV100); a pour point (PP) of about −12° C. or less; and a viscosity index (VI) of about 120 or greater. In addition to low pour point (PP), also low temperature fluidity of multi-grade engine oils is needed to guarantee that the engine starts easily at low temperature conditions. The low temperature fluidity is demonstrated as apparent viscosity in cold cranking simulation (CCS) tests at −5 to −40° C. Modern top-tier base oils having KV100 of about 4 cSt should typically have CCS viscosity at −30° C. (CCS-30) lower than 1800 cP and oils having KV100 of about 5 cSt should have CCS-30 lower than 2700 cP; the lower the value the better. In general, lubricating base oils should have Noack volatility no greater than current conventional Group I or Group II light neutral oils. Currently, only a small fraction of the base oils manufactured can be used in formulations to meet the latest, most demanding lubricant specifications.

It is no longer possible to produce lubricants complying with the specifications of the most demanding car manufacturers from conventional mineral base oils (API Group I, also Group II in some cases). Typically, said oils often contain too high concentrations of aromatic, sulfur, and nitrogen compounds, and further, they also have a high volatility and a poor viscosity index. Moreover, response of mineral oils to antioxidant additives is often modest. Synthetic (PAO; API Group IV) and so-called semi synthetic base oils (VHVI; API Group III) play an increasingly important role especially in automotive lubricants, such as in engine and gear oils. Service life of lubricants is desirably as long as possible, thus avoiding frequent oil changes by the user, and further allowing extended maintenance intervals of vehicles, for instance in commercial transportation. In the past decade, engine oil change intervals for passenger cars have increased five fold, being at best 50,000 km. For heavy-duty vehicles, engine oil change intervals are at present already on the level of 100,000 km. A similar "longer life" development can be seen in industrial lubricants.

Synthetic PAO type base oils are made by oligomerizing alpha-olefin monomers, followed by hydrogenation to achieve fully saturated paraffinic base oil. PAO base oils have relatively high VI values and at the same time excellent low temperature properties, PP being even below −60° C. Due to accurate product distillation, the volatilities of the products are low and flash points are high. The production and use of PAO base oils is rather limited due to the limited availability of expensive raw material, alpha-olefins.

Severely refined base oils of the VHVI type are produced from crude oil by removing undesired compounds. The most important step is the dewaxing, meaning the removal of solid, long-chain paraffins or, by modern technology, conversion of said n-paraffins to liquid isoparaffins. GTL base oil is made by isomerizing catalytically synthetic FT wax. In comparison to mineral oils, VHVI base oil products are more paraffinic and have narrower distillation range, thus having considerably higher VI, lower volatility and clearly better low temperature properties. The aromatic content of said oils is extremely low, and further, they are basically sulfur and nitrogen-free.

In addition to the technical demands for vehicle engine technology, also strict environmental requirements direct the industry to develop more sophisticated base oils. Sulfur-free fuels and base oils are required in order to gain full effect of new catalyst technologies in modern vehicles and to cut emissions of nitrogen oxides, volatile hydrocarbons and particles, as well as to achieve direct reduction of sulfur dioxide in exhaust gases. Conventional mineral oils contain sulfur, nitrogen, aromatic compounds, and are typically more volatile, and thus are more environmentally detrimental than newer sulfur-free base oils. In addition, mineral oils are not suitable for new engines with sensitive catalysts materials.

The production of base oils, too, is influenced by increasingly common "Life Cycle Assessment" (LCA) approach. The aim of LCA is to see the environmental load of the product "from cradle to grave". LCA is the tool to find the most critical points and to enable the changes towards an extended service life of the product, and minimal drawbacks to the environment associated with the production, use, handling, and disposal of the product. Longer oil change intervals of high-quality base oils result in decreased consumption of non-renewable crude oil and lowered amounts of hazardous waste oil. Nowadays, the use of recycled oils and renewable raw materials in the production of lubricants is frequently an object of interest. The use of renewable raw materials of biological origin instead of non-renewable fossil raw materials in the production of hydrocarbon components is desirable, because the fossil raw materials are exhaustible and their greenhouse gas (GHG) effect on environment is detrimental. Problems associated with recycled oils include complicated purification and reprocessing steps to obtain base oils with high quality. Further, the development of a functioning and extensive recycling logistic system is expensive.

So far, esters have been the only base oil type of renewable and biological origin used in lubricants. The use of said esters is limited to a few special applications such as chain-saw oils, bio-hydraulic oils and metal working oils. In normal automotive and industrial lubricants, esters are used mainly as additives. High price also limits the use of esters. In addition, the esters used in engine oil formulations are not interchangeable with other esters without re-running expensive engine tests, even in cases where the chemical composition of the substituting ester is in principle totally similar. Instead, base oils consisting of pure hydrocarbon structure are partly interchangeable with each other. There are also some technical problems associated with esters. As polar compounds, esters suffer greater seal-swelling tendency than pure hydrocarbons. This has created a number of problems relating to elastomers in hydraulic applications. In addition, ester base oils are hydrolyzed more easily producing acids, which in turn cause corrosion on lubricating systems. Further, even greater disadvantage of esters is that additives developed for non-polar hydrocarbon base oils are not effective for polar ester base oils.

FI 100248 presents a process with two steps wherein middle distillate is produced from plant oil by hydrogenation of the carboxylic acids or triglycerides of the plant oil to yield linear normal paraffins, followed by isomerization of said n-paraffins to give branched paraffins. The hydrogenation was performed at a temperature ranging from 330 to 450° C., under a pressure of higher than 30 bar and the liquid hourly space velocity (LHSV) being from 0.5 to 5 l/h. The isomerization step was carded out at 200 to 500° C. under elevated pressure, and LHSV being from 0.1 to 10 l/h.

EP 774451 discloses a process for isomerization of fatty acids or fatty acid alkyl esters. The isomerization of unsaturated fatty acids or fatty acid alkyl esters is performed using clay or another cationic catalyst. In addition to the main product, also feedstock dimers are obtained. After distillation, unsaturated branched fatty acids or fatty acid alkyl esters are obtained as the product.

GB 1 524 781 discloses a process for producing hydrocarbons from plant oil. In this process, plant oil feed is pyrolyzed in three zones in the presence of a catalyst at temperature of 300-700° C. In the process hydrocarbons of the gas, gasoline, and diesel classes are obtained. They are separated and purified.

EP 209997 discloses a process for producing base oils, comprising isomerization of waxy hydrocarbons based on crude oil, giving rise to only minor amounts of light fractions. This process is used for instance for producing base oils belonging to Group III from waxy bottoms of hydrocracking.

PAO processes are described in many patents. U.S. Pat. No. 6,703,356 discloses a process using large pore crystalline catalyst in production of PAO base oil from 1-alkene monomers, which are typically produced from crude oil based ethylene. This patent describes the use of higher α-olefin monomers, preferably C14 to C18, instead of typically used C10 (1-decene) or C8-C12 α-olefin mixture as starting material. Oligomerization of the α-olefins is followed by the distillation of the product to desired viscosity fractions, followed by hydrogenation to give saturated "star-shape" paraffins.

US 2005/0133408 discloses a base oil composition containing more than 10% by weight of cycloparaffins, having a ratio of monocycloparaffins to polycycloparaffins of above 15, further containing less than 0.3% by weight of aromatic compounds. The composition is obtained by subjecting isolated paraffinic wax obtained from Fischer-Tropsch synthesis to dewaxing by hydroisomerization and finally to hydrofinishing.

FI 66899 describes the use of fatty acid triglycerides and polymers thereof as base oil for lubricants. Double and ester bonds of the final product are instable due to oxidation and hydrolytic cracking. Base oils according to said publication comprise unsaturated esters. EP 03396078 presents a diesel fuel composition containing biocomponents, said composition comprising at least one component produced from a biological raw material of plant, animal or fish origin, diesel components based on crude oil and/or fractions from Fischer-Tropsch process, and optionally components containing oxygen.

The use of heteroatom containing starting materials of biological origin has so far not been reported for production of high-quality saturated base oils or base oil components.

Based on the above teachings, it may be found that there is an obvious need for a base oil and a base oil component of biological origin, said oil containing branched saturated paraffins, and further, fulfilling the highest quality requirements for base oils, the impacts of said oil on the environment, for end users, and for the saving of nonrenewable raw materials being more favorable in comparison to conventional mineral base oils, said base oil technically surpassing current prior art products.

OBJECT OF THE INVENTION

An object of the invention is to provide a new type of saturated base oil or a base oil component.

A further object of the invention is base oil or a base oil component based on raw materials of biological origin.

A further object of the invention is base oil or a base oil component based on raw materials of biological origin, said base oils or components complying with the quality requirements for t base oils of the API Group II+, preferably to Group III.

Another object of the invention is to provide saturated base oil or a base oil component based on raw materials of biological origin, the impacts of said oils or components on the environment, for end users, and for the saving of non-renewable raw materials being more favorable in comparison to conventional base oils based on crude oil.

The characteristic features of base oil or base oil component based on raw materials of biological origin according to the invention are presented in the appended claims.

GENERAL DESCRIPTION OF THE INVENTION

Figure 1:
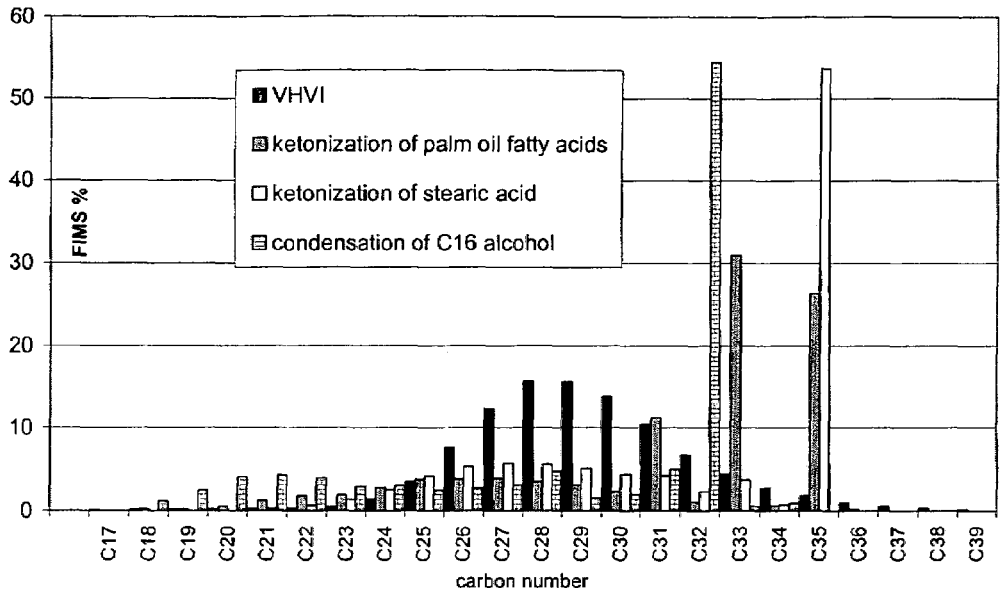
FIG. 1 is a graph showing the carbon number distributions of VHVI (413-520° C. cut) and the baseoils of the invention (360° C. cut).

Base oil or a base oil component based on raw materials of biological origin according to the invention mainly comprises saturated branched hydrocarbons with a carbon number range narrower than the range of the product distillates obtained by traditional methods. Said base oil or a base oil component complies with the quality requirements of the API Group II+, preferably Group III.

The term "saturated hydrocarbon" as used herein refers to paraffinic and naphthenic compounds, not to aromatics. Paraffinic compounds may either be branched or linear. Naphthenic compounds are cyclic saturated hydrocarbons, i.e. cycloparaffins. Such a hydrocarbon with a cyclic structure is typically derivative of cyclopentane or cyclohexane.

A naphthenic compound may comprise a single ring structure (mononaphthene) or two isolated ring structures (isolated dinaphthene), or two fused ring structures (fused dinaphthene) or three or more fused ring structures (polycyclic naphthalene or polynaphthenes).

In this context, the term polyol refers to alcohols having two or more hydroxyl groups.

In this context, width of carbon number range refers to the difference of the carbon numbers of the largest and the smallest molecules, plus one, in the final product.

In this context, fatty acids refer to carboxylic acids of biological origin, having a carbon number higher than C1.

In this context, pressures are gauge pressures relative to normal atmospheric pressure.

DETAILED DESCRIPTION OF THE INVENTION

It was surprisingly found that saturated, high-quality base oil or base oil component, comprising branched saturated hydrocarbons having carbon numbers of at least C18, and having a narrow carbon number range may be produced from starting materials of biological origin, said oils or components qualitatively corresponding to base oils of the API Group II+, preferably Group III. The distillation range (ASTM D 2887) of the base oil or base oil component of biological origin according to the invention starts above 250° C., carbon number range and boiling point range being extremely narrow, and further, the viscosity index being extremely high and at the same time low temperature properties being good. The base oil or base oil component of biological origin according to the invention contains at least 90% by weight of saturated hydrocarbons, the proportion of linear paraffins being less than 10% by weight.

Width of the carbon number range of the base oil or base oil component of the invention is typically less than nine carbons. Typical carbon number ranges and typical structures of the base oils of the invention are presented in Table 2 below, the most typical carbon number being in bold.

Carbon numbers and carbon number ranges of the base oils or base oil components of the invention depend on the biological starting material used as the feedstock, and further, on the production process. In the structural examples of the Table 2, the carbon number range of the base oil components 1 and 2 produced from C16/C18 feed by ketonization are typically from C31 to C35, and the carbon number range of the base oil component 3 produced from C16/C18 feed by condensation is typically from C32 to C36. These both represent the most common carbon number distribution of five carbon atoms. Feedstock comprising a single fatty acid chain length results in an extremely narrow carbon number range.

Biological base oil components of the invention presented in Table 2 are produced with the processes described below.

1. Isomerization of the tall oil fatty acid to give a branched product, followed by ketonization and finally hydrogenation.
2. Ketonization of palm oil acid fraction, followed by hydrogenation and finally isomerization.
3. Condensation of palm oil C16 fatty acid distillate, followed by hydrogenation and finally isomerization.

TABLE 2

Structures of the base oils/components of biological origin

| Base oil | Carbon number %, by FIMS | Structure |
|---|---|---|
| 1 | C31/C33/C35<br>acyclic component about 25%<br>mononaphthenes about 50%<br>dinapbthenes about 25% | 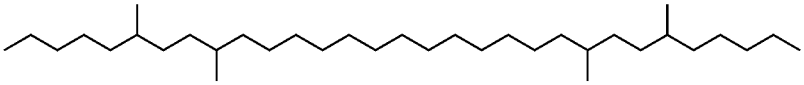 |

TABLE 2-continued

| Structures of the base oils/components of biological origin | | |
|---|---|---|
| Base oil | Carbon number %, by FIMS | Structure |
| | | 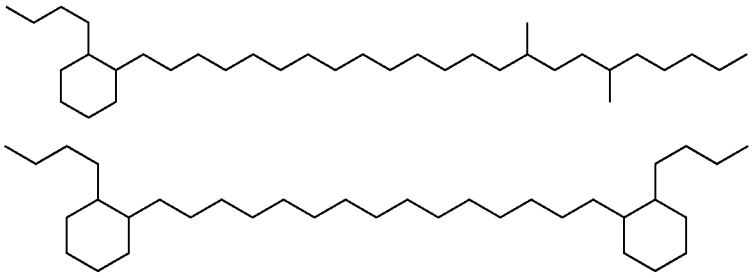 |
| 2 | C31/C33/C35<br>acyclic component about 90%<br>mononaphthenes about 10% | 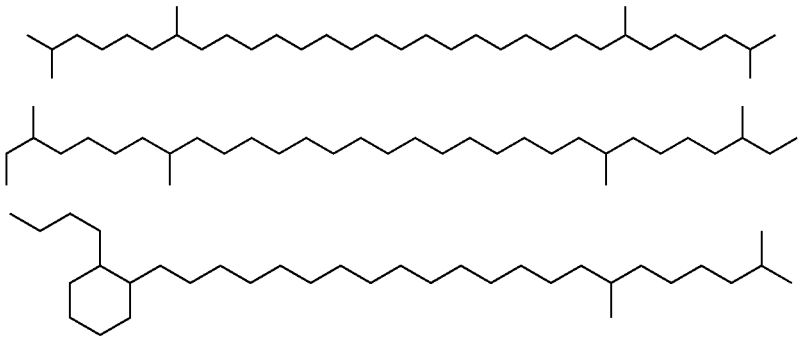 |
| 3 | C32/C34/C36<br>acyclic component about 90%<br>mononaphthenes about 10% | 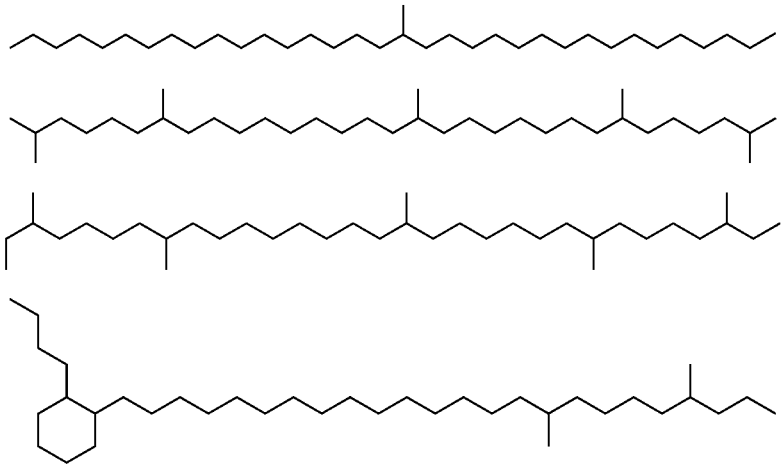 |

In Table 3, carbon numbers and assumed typical structures of known synthetic hydrocarbon base oils of mineral base having similar viscosity level are shown. Carbon number range is determined by the FIMS analysis. Structures of naphthenes are typical examples of a group of compounds.

TABLE 3

| Typical structures of known base oils | | |
|---|---|---|
| Base oil | Carbon number % by FIMS | Structure |
| 1<br>PAO C10 | C30<br>about 80% | 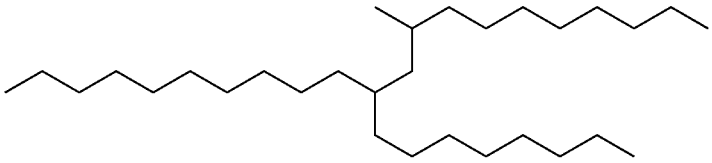 |

TABLE 3-continued
| Typical structures of known base oils | | |
|---|---|---|
| Base oil | Carbon number % by FIMS | Structure |
| | +C40 about 20% | 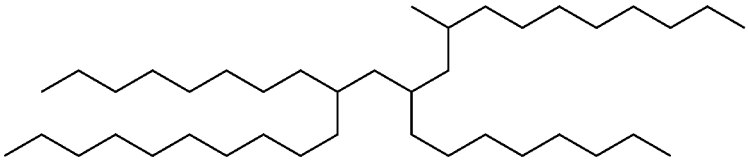 |
| 2 SLACK WAX (SW) | C25-C35 acyclic about 70% mononaphthenes about 25% dinaphthenes about 5% | 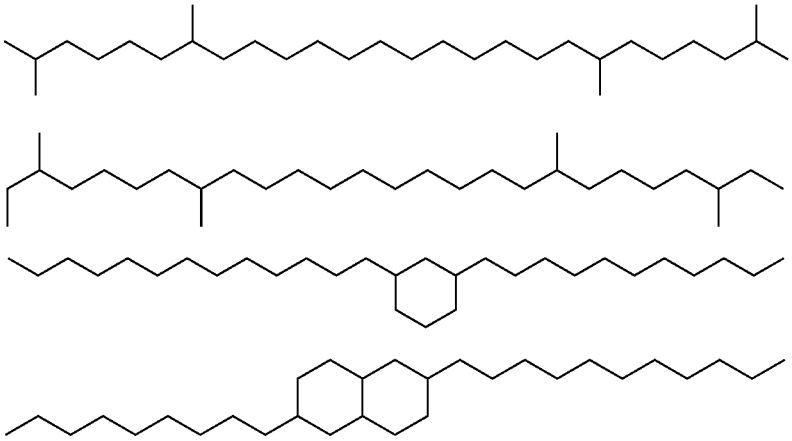 |
| 3 VHVI | C25-C35 acyclic about 40% mononaphthenes about 35% C25-C35 dinaphthenes about 15% other naphthenes about 10% | 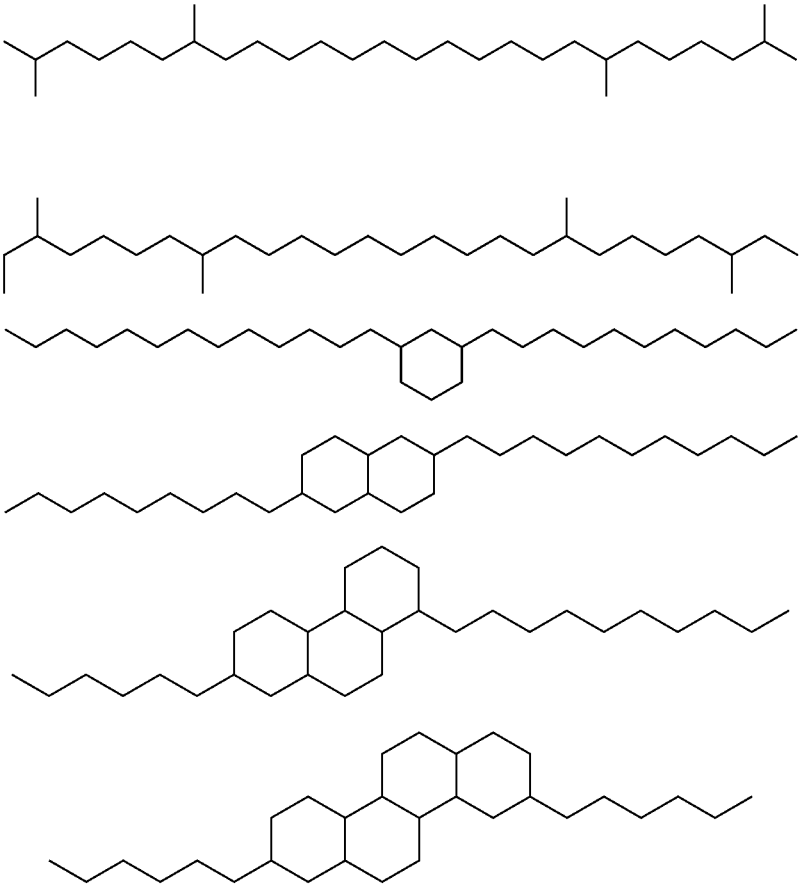 |

The products of Table 3 are typically produced as follows:

1. PAO C10 is produced from 1-decene by oligomerization using a homogeneous catalyst.
2. SW is the isomerization product of the Slack Wax fraction of mineral oil base.
3. VHVI is hydrocracked and isomerized base oil derived from mineral oil.

Saturated hydrocarbons are classified as follows using the FIMS method (field ionization mass spectrometry), according to the carbon and hydrogen atoms:

1 C(n).H(2n+2) paraffins
2 C(n).H(2n) mononaphthenes
3 C(n).H(2n−2) dinaphthenes
4 C(n).H(2n−4) trinaphthenes
5 C(n).H(2n−6) tetranaphthenes
6 C(n).H(2n−8) pentanaphthenes In Tables 2 and 3, the percentages (% by FIMS) refer to the groups of compounds determined according to said method.

With respect to molecular structures, the base oils or base oil components of the invention differ from the products of the prior art, as shown in Tables 2 and 3. Prior art PAO base oil mainly comprise long (>4 carbon) alkyl branches (structure 1 in Table 3). In the SW isomerization products of the prior art (structure 2 in Table 3), the short branches are typically at the end of the hydrocarbon skeleton. The base oils or base oils components of the invention shown as structures 2 and 3 in Table 2 are very similar to SW base oils, but SW base oil contains remarkable higher amount of mononaphthenes and also fused dinaphthenes.

When the isomerization is done based on the double bonds of the fatty acid skeleton (structure 1 in Table 2), there are typically from 1 to 4 carbon alkyl branches within the hydrocarbon chain of the product. Branched components are mixtures of isomers differing with respect to the branching sites.

Branches within the hydrocarbon chain decrease the pour point considerably more than those at the ends of the chain. In addition to the location of the branches, the number thereof influences pour point. Pour point is decreasing with the increasing number of side chains, simultaneously resulting in decreasing of the viscosity index. In the products of invention relatively high proportion of the isomerized molecules contains more than 30 carbon atoms. Such high molecular weight compounds typically also exhibit high VI even though pour point (PP) is lowered below −20° C.

As the result of cracking and hydrogenation of multiring aromatic compounds, there are also fused polynaphthenes with 3-5 rings (structure 3 in Table 3) in the VHVI products of prior art, however not present in the product of the invention. Fused naphthenes make PP-VI relation poorer than alkyl branches. The best PP-VI correlation can be achieved by optimal number of the branches at the right positions.

The product of the invention obtained by the isomerization of the paraffin wax from hydrodeoxygenated ketone (structure 2 in table 2) is branched product with lower amount of methyl branches at the ends of the hydrocarbon chain and more methyl or ethyl branches within the hydrocarbon skeleton. Said base oil typically comprises some mononaphthenes, but no fused dinaphthenes nor polynaphthenes. Said mononaphthenes are formed as the result of reactions of the double bonds of the fatty acid carbon chain or in isomerization reaction, thus differing with respect to their structure from the naphthenes obtained by hydrogenation of aromatics and cracking of polynaphthenes in mineral oil.

The product obtained using the condensation reaction either with the aldol condensation, alcohol condensation (Guerbet reaction) or radical process comprises a methyl branch in the middle of the main hydrocarbon chain (structure 3 in Table 2). The product differs from the VHVI and SW isomerization products of the prior art (structures 3 and 2 in Table 3) said oils typically having branches mainly at the ends of the chains.

The base oil or base oil component according to the invention comprises a product produced from starting materials of biological origin, said product containing less than 10% by weight, preferably less than 5% by weight and particularly preferably less than 1% by weight of linear paraffins; at least 90% by weight, preferably at least 95% by weight, and particularly preferably at least 97% by weight, at best at least 99% by weight, of saturated hydrocarbons, as determined by gas chromatographic (GC) assay.

The product of the invention contains 5-50, preferably 5-30, particularly preferably 5-15 and at best 5-10% by FIMS by FIMS of mononaphthenes; and less than 0.1% by FIMS of polynaphthenes, as determined by the FIMS method.

For said base oil or base oil component, the VI is more than 115 and preferably more than 130, particularly preferably more than 140, and at best more than 150, as determined by the method of ASTM D 2270, together with pour point being not over −9° C., preferably not over −12° C. and particularly preferably not over −15° C. (ASTM D 5950).

Low temperature dynamic viscosity, CCS-30, for said base oil or base oil component is no more than $29.797*(KV100)^{2\ 7848}$ cP, preferably no more than $34.066*(KV100)^{2\ 3967}$ cP; CCS-35 is no more than $36.108*(KV100)^{3\ 069}$ cP, preferably no more than $50.501*(KV100)^{2\ 4918}$ cP measured by method ASTM D 5293; pour point being lower than −9° C., preferably lower than −12° C. and particularly preferably lower than −15° C. (ASTM D 5950).

For said base oil or base oil component, the volatility of product, having KV100 from 3 cSt to 8 cSt, is no more than $2271.2*(KV100)^{-3\ 5373}$% by weight as determined by the method of DIN 51581-2 (Mathematical Noack method based on ASTM D 2887 GC distillation).

Carbon number range of base oils or base oil components of the invention is no more than 9 carbons, preferably no more than 7 carbons, particularly preferably no more than 5 carbons, and at best no more than 3 carbons, as determined by the FIMS method. More than about 50%, preferably more than about 75% and particularly preferably more than about 90% by weight of the base oil contains hydrocarbons belonging to this narrow carbon number distribution.

Distillation range of base oils or base oil components of the invention is no more than 150° C., preferably no more than 100° C., particularly preferably no more than 70° C., and at best no more than 50° C. (determined by the method of ASTM D 2887, distillation points D10 and D90).

Sulfur content of said base oil or base oil component is less than 300 ppm, preferably less than 50 ppm, particularly preferably less than 10 ppm, and at best less than 1 ppm as determined by the method of ASTM D 3120.

Nitrogen content of said base oil or base oil component is less than 100 ppm, preferably less than 10 ppm, and particularly preferably less than 1 ppm, as determined by the method of ASTM D 4629.

Said base oil or base oil component contains carbon $^{14}C$ isotope, which may be considered as an indication of the use of renewable raw materials. Typical $^{14}C$ isotope content of the total carbon content in the product, which is completely of biological origin, is at least 100%. Carbon $^{14}C$ isotope content (proportion) is determined on the basis of radioactive carbon (carbon $^{14}C$ isotope) content in the atmosphere in 1950 (ASTM D 6866). $^{14}C$ isotope content of the base oil according to the invention is lower in cases where other components besides biological components are used in the processing of the product, said content being, however, more than 50%, preferably more than 90%, particularly preferably more than 99%. In this way, even low amounts of base oil of biological origin may be detected in other types of hydrocarbon base oils.

Base oil or base oil component of the invention may be prepared from feedstock originating from starting material of biological origin, called biological starting material in this description. The biological starting material is selected from the group consisting of;

a) plant fats, oils, waxes; animal fats, oils, waxes; fish fats, oils, waxes, and
b) fatty acids or free fatty acids obtained from plant fats, plant oils, plant waxes; animal fats, animal oils, animal waxes; fish fats, fish oils, fish waxes, and mixtures thereof by hydrolysis, transesterification or pyrolysis, and
c) esters obtained from plant fats, plant oils, plant waxes; animal fats, animal oils, animal waxes; fish fats, fish oils, fish waxes, and mixtures thereof by transesterification, and
d) metal salts of fatty acids obtained from plant fats, plant oils, plant waxes; animal fats, animal oils, animal waxes; fish fats, fish oils, fish waxes, and mixtures thereof by saponification, and
e) anhydrides of fatty acids from plant fats, plant oils, plant waxes; animal fats, animal oils, animal waxes; fish fats, fish oils, fish waxes, and mixtures thereof, and
f) esters obtained by esterification of free fatty acids of plant, animal and fish origin with alcohols, and
g) fatty alcohols or aldehydes obtained as reduction products of fatty acids from plant fats, plant oils, plant waxes; animal fats, animal oils, animal waxes; fish fats, fish oils, fish waxes, and mixtures thereof, and
h) recycled food grade fats and oils, and fats, oils and waxes obtained by genetic engineering, and
i) mixtures of said starting materials.

Biological starting materials also include corresponding compounds derived from algae and insects as well as starting materials derived from aldehydes and ketones prepared from carbohydrates.

Examples of suitable biological starting materials include fish oils such as baltic herring oil, salmon oil, herring oil, tuna oil, anchovy oil, sardine oil, and mackerel oil; plant oils such as rapeseed oil, colza oil, canola oil, tall oil, sunflower seed oil, soybean oil, corn oil, hemp oil, olive oil, cottonseed oil, mustard oil, palm oil, peanut oil, castor oil, jatropha seed oil, palm kernel oil, and coconut oil; and moreover, suitable are also animal fats such as lard, tallow, and also waste and recycled food grade fats and oils, as well as fats, waxes and oils produced by genetic engineering. In addition to fats and oils, suitable starting materials of biological origin include animal waxes such as bee wax, Chinese wax (insect wax), shellac wax, and lanoline (wool wax), as well as plant waxes such as carnauba palm wax, ouricouri palm wax, jojoba seed oil, candelilla wax, esparto wax, Japan wax, and rice bran oil.

The biological starting material may also contain free fatty acids and/or fatty acid esters and/or metal salts thereof, or cross-linked products of the biological starting material. Said metal salts are typically alkali earth metal or alkali metal salts.

Base oil or base oil component of the invention, comprising hydrocarbons typically having carbon number of at least 18, may be produced from biological starting materials by methods resulting in the lengthening of the carbon chain of the starting material molecules to the level necessary for the base oils (>C18). Suitable methods include processes based on the condensation reactions, meaning reactions based on the functionality of the feed molecules, in combination with at least one of the following: reduction, transesterification, hydrolysis, metathesis, decarboxylation, decarbonylation, isomerization, dewaxing, hydrogenation and finishing process or reaction. Condensation reactions include for example decarboxylative condensation (ketonization), aldol condensation, alcohol condensation (Guerbet reaction), and reactions on double bonds including dimerisation, trimerisation, oligomerisation and radical reactions. Hydrocarbons, preferably saturated hydrocarbons are obtained as the product by processing of the biological starting materials, followed, when necessary, by fractionation of said hydrocarbons by distillation to obtain final products.

In the method based on ketonization reactions, the acid groups of fatty acids react with each other giving ketones. Ketonization may also be carried out with fatty acid esters, fatty acid anhydrides, fatty alcohols, fatty aldehydes, natural waxes, and metal salts of fatty acids. The ketone obtained is reduced giving a paraffin, followed by isomerization, to improve low temperature properties of the final product. Isomerization is optional in cases branched feedstock is subjected to ketonization. In the ketonization step, also dicarboxylic acids or polyols including diols, may be used as starting material allowing longer chain lengthening than with fatty acids only. In said case, a polyketonic molecule is obtained, to be processed in a similar manner as monoketone. In the ketonization reaction, the pressure is between 0 and 10 MPa, the temperature being between 10 and 500° C., and moreover, supported metal oxide catalysts are used, the metal being preferably molybdenum, nickel-molybdenum, manganese, magnesium, calcium, or cadmium; silica and/or alumina as the support may be used. Particularly preferably the metal in metal oxide is molybdenum, manganese and/or magnesium in a catalyst without support.

In aldol condensation reaction the aldehydes and/or ketones are condensed to substantially increase the carbon number of the hydrocarbon stream. Saturated aldehydes are preferably used as the feedstock. In the process branched unsaturated aldehydes or ketones are obtained. The catalyst is preferably an alkali or an alkaline earth metal hydroxide, for instance NaOH, KOH or $Ca(OH)_2$, the temperature being then from 80 to 400° C., preferably lower temperature is used with lower molecular weight feeds and higher temperatures with higher molecular weight feed. The amount of the catalyst to be used in the homogeneous reaction varies from 1 to 20%, preferably from 1.5 to 19%, by weight.

In alcohol condensation reaction, particularly the Guerbet reaction, the alcohols are condensed to substantially increase the carbon number of the hydrocarbon stream, thus obtaining branched monofunctional and branched polyfunctional alcohols respectively from monohydroxy, and polyhydroxy alcohols in the condensation reaction of alcohols. Saturated alcohols are preferably used as the feedstock. Known catalysts of the Guerbet reaction, such as hydroxides and alkoxides of alkali and alkaline earth metals, or metal oxides in combination with a co-catalyst may be used as reaction catalysts. The amount of the catalyst to be used in the reaction varies from 1 to 20%, preferably from 1.5 to 19%, by weight. Suitable co-catalysts include salts of chromium(III), manganese(II), iron(II), cobalt(II) or lead(II), or stannic oxide or zinc oxide, the salts being salts soluble in water or alcohols, preferably sulfates. Co-catalyst is used in amounts varying between 0.05 and 1%, particularly preferably between 0.1 and 0.5%, by weight. Hydroxides of alkali metals together with zinc oxide serving as the co-catalyst are preferably used in the reaction. Chain lengthening by means of the condensation reaction of alcohols is performed at 200 to 300° C., preferably at 240 to 260° C., the reaction being carried out under vapor pressure provided by the alcohols present in the reaction mixture. Water is liberated in the reaction, said water being continuously separated.

In the radical reaction, carbon chains of the saturated carboxylic acids are lengthened with alpha olefins. In the radical reaction step, the feedstock comprising saturated carboxylic acids and alpha olefins in a molar ratio of 1:1 are reacted at 100 to 300° C., preferably at 130 to 260° C. under a vapor pressure provided by the reaction mixture, in the presence of an alkyl peroxide, peroxyester, diacylperoxide or peroxyketal catalyst. Alkyl peroxides such as ditertiary butyl peroxide catalysts are preferably used. The amount of the catalyst used in the reaction is from 1 to 20%, preferably from 1.5 to 10%, by weight. A branched carboxylic acid is obtained as the reaction product.

In electro-chemical synthesis carboxylic acids, particularly fatty acids in plant oils are first extracted, followed by forming salts of carboxylic acids by dissolving them into methanol or aqueous methanol solution, containing 10-20% by weight of potassium hydroxide for neutralizing carboxylic acids, to form an electrolyte solution for electro-chemical oxidation. The salts are transformed to long-chain hydrocarbons by the reaction known as Kolbe synthesis. The carbon number of the obtained product is one carbon lower than that obtained using the ketonisation reaction.

Reduction of the product obtained from the chain-lengthening step to hydrocarbons (paraffin) is carried out by hydrogenation, thus removing the polarity due to oxygen atoms, and further, oxidation stability is improved by saturating any double bonds. In the hydrogenation, the product of the chain lengthening reaction and hydrogen gas are passed to the hydrogenation reactor at a pressure typically between 1 and 15 MPa and the temperature from 150 to 400° C. In the hydrogenation step, special catalysts containing metals of the Group VIII and/or VIA of the periodic system of the elements on a support may be used. Hydrogenation catalyst is typically a supported Pd, Pt, Ru, Rh, Ni, NiMo, or CoMo catalyst, the support being activated carbon, alumina and/or silica. After reduction the methyl branched paraffinic wax is obtained from the other feeds but ketonization of the nonbranched feed components.

Low temperature properties of the product may be improved by isomerization. In isomerization the linear hydrocarbons are converted to branched ones and the solid paraffins are thus becoming liquid. In the isomerization, hydrogen gas and paraffinic components react in the presence of an isomerization catalyst. In the isomerization step, the pressure is typically between 1 and 15 MPa, the temperature being typically between 200 and 400° C. Special catalysts containing molecular sieves and a metal from the Group VIII of the periodic system of the elements, such as Ni, Pt and Pd, may be used. Alumina and/or silica may serve as the support. Isomerization is not necessary if branched structures are obtained from chain lengthening reaction, and if the pour point of the product is low enough.

Products produced from biological starting materials using methods described above mainly comprise saturated hydrocarbons and mixtures thereof. They may be used as base oils and as components for producing base oils depending on which are the desired properties of the base oil. High-quality base oil or a base oil component of the API Group II+, preferably Group III is obtained as the product, said base oil or base oil component being particularly suitable for the production of high-quality lubricants, white oils, process oils, and oils for metal working fluids.

ADVANTAGES OF THE INVENTION

The base oil or the base oil component of the invention is endowed with superior technical properties compared to conventional hydrocarbon oils of the corresponding viscosity class. Narrow boiling point range indicates that the product does not contain any initial light fraction (meaning the molecules considerably lighter than the average) shown by the decreased volatility of the product. This results in lower oil consumption and reduced emissions in practical applications. The "tail" composed of the heavier components (meaning the molecules considerably heavier than the average) is also missing. This results in excellent low temperature properties of the product.

For the base oil or base oil component of the invention, the carbon number and boiling point range may be adjusted to desired range by the selection of feedstock composition. For base oils of the prior art, the boiling point range is adjusted by distilling the product to obtain a fraction having the desired kinematic viscosity. It is preferable that lubricants comprise base oils with narrow carbon number ranges and thus narrow boiling point ranges. In this way the base oil contain molecules of similar sizes behaving under different conditions in a similar way.

Base oil or base oil component of the invention consists mainly of isomerized paraffins, the rest being mononaphthenes, and to lower extent, non-fused dinaphthenes. It is known that mononaphthenic compounds and also non-fused dinaphthenes posses similar physical properties as isoparaffins. Fused naphthenes in prior art products have lower VI and poor temperature viscosity properties, as well as poorer oxidation stability.

For the base oil or base oil component of the invention, high VI of the product means in practice that the amount of the viscosity index improver, VII, typically used in lubricating oil compositions may be reduced. It is generally known that for instance in engine oils, the VII component is the main cause for deposits in the engine. In addition, reduction of the amount of VII results in significant savings in formulation costs.

Opposed to conventional products derived from crude oil, no sulfur, nitrogen, nor aromatic compounds are present in base oil or base oil component of the invention, allowing for the safe use thereof in such applications wherein the users are exposed to oil or oil mist. Moreover, response of the product of the invention to antioxidants and pour point depressants (PPD) is excellent, thus allowing for the extension of the service life of the lubricants prepared from said base oil, as well as the use thereof at lower temperatures.

In comparison to esters or other base oils containing hetero atoms, the base oil or base oil component of the invention is more stable with respect to hydrolysis, that is, it will not readily decompose releasing corrosive acids under humid conditions. The base oil of the invention is also chemically more stable than the more reactive ester, base oils, and moreover; the oxidation resistance thereof is improved compared to ester base oil derived from unsaturated fatty acids of biological origin.

Compared to esters, the nonpolar base oil or base oil component of the invention is more compatible with conventional hydrocarbon base oil components derived from crude oil, base oil components obtained from Fischer-Tropsch process, as well as with lubricant additives. Moreover, there are no such problems with elastomers, such as sealant materials as encountered with esters.

Advantages of the base oil or base oil component of the invention include the fact that it complies with the requirements for base oils according to API Group II+, preferably Group III, and may be used in automotive engine oil compositions like other base oils of API classification, according to same base oil interchange rules.

The base oil or base oil component of the invention is derived from renewable natural resources as can be analyzed from the $^{14}C$ isotope content of the product.

According to the invention renewable biological raw materials make a fully novel resource of starting materials for high-quality saturated hydrocarbon base oil or base oil component. Also carbon dioxide emissions contributing to the greenhouse effect may be reduced by using renewable raw materials instead of non-renewable resources.

The invention is now illustrated by means of the following examples without wishing to limit the scope thereof.

EXAMPLES

In Examples 1 to 5 paraffinic hydrocarbons with long chains are produced from biological starting materials containing oxygen by a process based on ketonization. The products are well suited as base oils or base oil components without blending limitations, and further, the products are compatible also with lubricant additives. In Example 6, the detection of the proportion of base oil of biological origin in traditional mineral base oil is shown. Table 4 shows the properties of the base oil components prepared in Examples 1 to 5 from biological starting materials, and Table 5 shows properties of products of the prior art.

Example 1

Preparation of a Hydrocarbon Component from Stearic Acid Fraction

A mixture of plant oils (linenseed, soybean, sunflower, and rapeseed oils) was hydrolyzed, and the fatty acids were distilled to obtain product fractions according to carbon numbers. Double bonds of the fatty acid fraction used as the feed were selectively prehydrogenated. The stearic acid fraction ($C_{17}H_{35}COOH$) thus obtained was diluted with a paraffinic diesel fuel based on biological raw material. The stearic acid content of the mixture was 31% by weight. The feedstock was ketonized in a continuous tube reactor using a $MnO_2$ catalyst. The temperature of the reactor was 370° C., and WHSV was 3. 18-pentatriacontanone, i.e., stearone, in a diluent was obtained as the product.

In the hydrogenation step, said stearone/diluent mixture obtained was hydrogenated in a high pressure Parr reactor using a dried and activated $NiMo/Al_2O_3$ catalyst to obtain linear paraffin. The ketone was hydrogenated at 330° C. under a pressure of 5 MPa until no ketone peal was present in the IR spectrum of a sample, mixing speed being 300 rpm. Stearic acid resulted in linear C35 paraffin.

The linear paraffin wax obtained from the ketone was isomerized in a Parr reactor to get a blanched paraffin of the base oil class, using reduced Pt molecular sieve/$Al_2O_3$ as the catalyst. Preheated paraffin/diluent mixture obtained above was isomerized under a hydrogen pressure of 3 MPa and at 340° C. until PP of −6° C. was obtained. Finally, light fractions were distilled off under vacuum, followed by finishing of the paraffinic product by filtering through kieselguhr.

Example 2

Preparation of a Hydrocarbon Component from Fatty Acids Derived from Palm Oil Palm oil was hydrolyzed, and double bonds were selectively hydrogenated. After hydrogenation, the fatty acid composition was as follows: C14 1%, C16 44%, C18 54%, and C20 1%, all percentages being by weight. Fatty acids were ketonized as in Example 1, and the ketonization was followed by removal of the solvent by distillation.

In the hydrogenation step, the ketone mixture obtained above was hydrogenated in a Parr reactor using a dried and activated $NiMo/Al_2O_3$ catalyst to give a linear paraffin. The ketone mixture was hydrogenated under a pressure of 3.3 MPa, at 340° C., mixing speed being 300 rmp. Palm oil resulted in linear paraffin.

N-paraffin wax obtained from the ketone mixture, by hydrogenation, was isomerized in a Parr reactor at 340° C. under a hydrogen pressure of 3 MPa to give a branched paraffin of base oil viscosity class, using a reduced Pt molecular sieve/$Al_2O_3$ catalyst until PP point was below −15° C. Finally, light fractions were distilled off under reduced pressure.

Example 3

Preparation of a Hydrocarbon Component from Fatty Acid Methyl Esters

Purified animal fat was transesterified in two steps with methanol under alkaline conditions at 70° C. under a pressure of 0.1 MPa, thus obtaining fatty acid methyl esters. Sodium methoxide served as the catalyst. The reaction mixture was purified by washing with acid and water. Finally, the mixture of fatty acid methyl esters was dried.

The mixture of fatty acid methyl esters was diluted with a paraffinic diesel fuel of biological origin. Fatty acid methyl ester content of the feedstock obtained was 30% by weight, and the feedstock was ketonized in a continuous tube reactor as disclosed in Example 1. Both saturated and unsaturated ketones were thus obtained as products.

In the hydrogenation step, the ketone mixture obtained above was hydrogenated in a Parr reactor as in Example 2. Also the isomerization was performed as in Example 2.

Example 4

Preparation of a Hydrocarbon Component from Tall Oil Based Isomerized Fatty Acids Mixture of fatty acids from distilled tall oil was isomerized using a mordenite catalyst in a Parr reactor. H mordenite zeolite served as the catalyst, and water was used in an amount of 3% by weight of the total mass of the reaction mixture. The mixture was purged with nitrogen. The isomerization temperature was 280° C., nitrogen pressure was 2.0 MPa, and mixing speed was 300 rpm. The catalyst was filtered off, followed by the distillation of the monomeric acids from the product under reduced pressure.

Double bonds of the monomeric acids were selectively hydrogenated in a Parr reactor using a Pd/C catalyst. The hydrogenation was performed at 150° C., under a hydrogen pressure of 1.8 MPa. Linear fatty acids were removed from the mixture by adding a double amount of hexane, followed by cooling the mixture to −15° C. and filtering off the crystals formed. Finally, the solvent was distilled off from the isostearic acid fraction.

The iso-stearic acid fraction was diluted with a paraffinic diesel fuel of biological origin in a ratio of 30 to 70% by weight. The feedstock was ketonized in a continues tube reactor using a $MnO_2$ catalyst. The temperature of the reactor was 370° C., the WHSV being 1.7. A mixture of isomerized ketones was thus obtained as the product.

In the hydrogenation step, the ketone mixture thus obtained was hydrogenated in a Parr reactor as in Example 2. The solvents were distilled off from the final product under reduced pressure. Thereafter, n-paraffins were extracted from the product by solvent dewaxing method, and finally, the paraffinic product was finished by filtering through kieselguhr. Mainly branched paraffins were obtained as the final product.

Example 5

Preparation of a Hydrocarbon Component from Tall Oil Based Isomerized Fatty Acids and Dicarboxylic Acid The isostearic acid fraction prepared according to Example 4 and C6 dicarboxylic acid (adipic acid) were mixed in a molar ratio of 1:3. The feed mixture was ketonized in a Parr reactor using a MgO catalyst. The acid mixture was ketonized at 340° C., using a mixing speed of 300 rpm.

In the hydrogenation step, the ketone mixture thus obtained was hydrogenated in a Parr reactor as in Example 1, and light fractions were distilled off from the final product under reduced pressure. As the product, branched paraffins having longer chains in comparison to other examples were obtained.

Summary of the Examples 1-5

Proceeding as in Examples 1-5, base oil components may also be produced from other plant, fish, animal or recycled food fats and oils (e.g. deep-fry oils), or esters or soaps derived from fatty acids of said fats and oils, or corresponding alcohols and free fatty acids. Hydrocarbon components may also be produced from natural waxes consisting of fatty acids and alcohols by proceeding in a similar manner. On the other hand, corresponding alcohols may be prepared from fatty acids using for instance a Ru/C catalyst, and said alcohols may be traditionally esterified with fatty acids. Esters of the carbon number C36 are thus obtained for ketonization, while natural waxes are typically C38-C46 esters.

Example 6

Preparation of a Hydrocarbon Component from C16 Alcohol Derived from Plant Oil For condensation reaction 200 g of C6 fatty alcohol, palladium chloride (5 ppm palladium) and 12 g of sodium methoxylate were weight in a Parr reactor. Mixing was adjusted to 250 rpm, temperature to 250° C. and pressure to 0.5 MPa. Slight nitrogen purge was maintained to sweep out water liberated in reaction. Reaction was carried out until the amount of condensated alcohol was stabilized in GC analysis. After reaction the product was neutralized with hydrochloric acid, washed with water and dried with calcium chloride.

In the next HDO step, the condensed alcohol obtained above was hydrogenated in a high pressure Parr reactor using a dried and activated $NiMo/Al_2O_3$ catalyst, to give a methyl branched paraffin. The aldehyde was hydrodeoxygenated at 340° C., under a pressure of 5 MPa, mixing at 300 rpm until no alcohol peak was detected in the FTIR spectrum. The pour point of methyl branched wax was 69° C.

The C32 paraffin wax obtained above was isomerized in a Parr reactor to give a branched paraffin of the base oil class using a reduced Pt molecular sieve/$Al_2O_3$ catalyst. Preheated paraffin was isomerized under a hydrogen pressure of 3 MPa and at 340° C. until a pour point under −15° C. was obtained. Finally, light fractions were distilled from the product at reduced pressure. The properties of the condensed, hydrodeoxygenated and hydroisomerized baseoil are given in table 3.

Similar hydrocarbon compounds may be produced by other condensation reactions and in radical reactions in a similar way.

TABLE 4

Properties of the products produced in Examples 1–6.

| Analysis | Ex. 1 | Ex. 2 | Ex. 3 | Ex. 4 | Ex. 5 | Ex. 6 | Method |
|---|---|---|---|---|---|---|---|
| KV100 (cSt) | 5.2 | 4.3 | 5.8 | 6.5 | 16.4 | 4.3 | ASTM D445 |
| KV40 (cSt) | 23.0 | 18.3 | 27.7 | 34.0 | 150.5 | 18.2 | ASTM D445 |
| VI | 164 | 153 | 159 | 148 | 115 | 145 | ASTM D2270 |
| Pour point (° C.) | −6 | −21 | −18 | −12 | −12 | −26 | ASTM D5950 |
| GC distillation (° C.) | | | | | | | ASTM D2887 |
| 10% | 419 | 375 | | 455 | | 390 | |
| 50% | 475 | 457 | | 481 | | 444 | |
| 90% | 486 | 474 | | 497 | | 455 | |
| GC-Noack (w-%) | 5.8 | 12.5 | | 4.2 | | 11.1 | DIN 51581-2 |
| Molecular distribution (w-%) | | | | | | | |
| Aromatics | 0 | | | 0 | | | ASTM D2549 |
| Paraffins | 88 | | | 31 | | 90.4 | FIMS |
| Mononaphthenes | 12 | | | 49 | | 9.2 | FIMS |
| Dinaphthenes | 0 | | | 20 | | 0.4 | FIMS |
| Other naphthenes | 0 | | | 0 | | 0 | FIMS |
| Sulfur, ppm | <1 | | | <1 | | | ASTM D3120/ D4294 |
| Nitrogen, ppm | <1 | | | <1 | | | ASTM D4629 |

TABLE 5

Properties of the base oils of the prior art

| Analysis | API GpIII, HC-CDW | API GpIII, HC-CDW | API GpIII, SW | API GpIV, PAO | Method |
|---|---|---|---|---|---|
| KV100 (cSt) | 4.29 | 6.00 | 4.0 | 5.7 | ASTM D445 |
| KV40 (cSt) | 20.0 | 33.1 | 16.8 | 30 | ASTM D445 |
| VI | 122 | 128 | 140 | 135 | ASTM D2270 |
| Pour point (° C.) | −18 | −12 | −21 | <−63 | ASTM D5950 |
| CCS at −30° C. (cP) | 1750 | 4100 | | 2300 | ASTM D5293 |
| CCS at −35° C. (cP) | 3100 | 7800 | 1560 | 3850 | ASTM D5293 |
| GC distillation (° C.) | | | | | ASTM D2887 |
| 10% | 395 | 412 | 394 | | |
| 50% | 421 | 459 | 421 | | |
| 90% | 456 | 513 | 459 | | |
| GC-Noack, w-% | 13.3 | 5.8 | 12.5 | | DIN 51581-2 |
| Molecular distribution, w-% | | | | | |
| Aromatics | 0.0 | 0.0 | 0.0 | 0.0 | ASTM D2549 |
| Paraffins | 37.0 | 26.8 | 72.4 | 100 | FIMS |
| Mononaphthenes | 37.3 | 39.3 | 23.9 | 0 | FIMS |
| Dinaphthenes | 16.1 | 20.3 | 3.5 | 0 | FIMS |
| Other naphthenes | 9.8 | 13.6 | 0.2 | 0 | FIMS |
| Sulfur, ppm | <0.2 | <0.2 | | <1 | ASTM D3120/D 4294 |
| Nitrogen, ppm | <1 | <1 | | <1 | ASTM D4629 |

HC-CDW = hydrocracked, catalytically dewaxed base oil

Example 7

Preparation of a Hydrocarbon Component from Fatty Acids Derived from Palm Oil Palm oil was hydrolyzed. Fatty acids derived from palm oil were used as the feedstock following selective prehydrogenation of the double bonds of said fatty acids. The fatty acids were vaporized with nitrogen purge in a separate vaporizer unit and ketonised continuously at atmospheric pressure, in a tubular reactor using a $MnO_2$ as catalyst. Temperature of the reactor was 380° C., the WHSV of the feed being 1 l/h-l.

The C31, C33, C35 ketone mixture obtained from the ketonisation stage was hydrodeoxygenated continuously in a tubular fixed bed reactor using a dried and activated NiMo/$Al_2O_3$ catalyst to give linear paraffins. Hydrodeoxygenation was carried out under a pressure of 4 MPa (40 bar), at 270° C. and with WHSV of 1 l/h.

The linear paraffin wax obtained in the HDO step was isomerized continuously in a tubular fixed bed reactor using a reduced Pt molecular sieve/$Al_2O_3$ catalyst to give branched paraffins using a reduced Pt molecular sieve/$Al_2O_3$ catalyst. Isomerization was performed at 340° C., under a hydrogen pressure of 4 MPa until the pour point of the product was below −15° C. Finally, light fractions were distilled under reduced pressure and separated.

Hydrocarbon components may also be produced in a similar way from other plant and fish oils, and animal fats.

TABLE 6

Properties of the products in example 7.

| Method | Analysis | baseoil >413° C. | baseoil 356–413° C. |
|---|---|---|---|
| ASTM D 4052 | Density @ 15° C., kg/m3 | 821.8 | 810.1 |
| ASTM D 5950 | Pour Point, ° C. | −23 | −32 |
| ASTM D 5771 | Cloud Point, ° C. | −6.8 | −24.7 |
| ASTM D 5293 | CCS-30, mPas | 1780 | |
| | CCS-35, mPas | 2920 | 690 |

TABLE 6-continued

Properties of the products in example 7.

| Method | Analysis | baseoil >413° C. | baseoil 356–413° C. |
|---|---|---|---|
| ASTM D 445 | kV40, cSt | 25.7 | 10.9 |
| ASTM D 445 | kV100, cSt | 5.4 | 2.9 |
| ASTM D 2270 | VI | 153 | 126 |
| ASTM D 2887 | 10%, ° C. | 431 | 355 |
| | 50%, ° C. | 453 | 384 |
| | 90%, ° C. | 497 | 415 |
| DIN 51581-2 | GC Noack | 4.4 | 33.1 |
| FIMS | paraffins | 90.5 | |
| | mononaphthenes | 9.5 | |
| | dinaphthenes | 0 | |
| | other naphthenes | 0 | |
| ASTM D 3120 | S, mg/kg | 0 | 0 |
| ASTM D 4629 | N, mg/kg | 0 | 0 |

Example 8

Determination of the Biological Origin of the Hydrocarbon Component

Hydrocarbon component of biological origin was weighed into mineral oil based Group III base oil, and mixed thoroughly. For the first sample, 0.5014 g of the hydrocarbon component of biological origin was weighed, and base oil component of the Group III was added in an amount to obtain a total weight of 10.0000 g; for the second sample, 1.0137 g of the hydrocarbon component of biological origin was weighed, and base oil component of the Group III was added in an amount to obtain a total weight of 10.0232 g. The measured results are summarized in Table 6, below. Content of radioactive carbon is expressed as "percent modern carbon", based on the content of radioactive carbon of the atmosphere in 1950. At present, the content of radioactive carbon of the atmosphere is about 107%, $\delta^{13}$ C value shows the ratio of stable carbon isotopes $^{13}C/^{12}C$. By means of this value, the isotope fractionation found in our process may be corrected. Actual results are presented in the last column.

TABLE 7

| Content of radioactive carbon | | | |
|---|---|---|---|
| Sample | $^{14}C$ content, % | $\delta^{13}C$ | Bio proportion, % |
| Mineral oil | 0.1 ± 0.07 | −29.4 | 0 |
| Bio oil | 106.7 ± 0.4 | −28.9 | 100 |
| Mineral + bio, 5% by weight | 5.0 ± 0.3 | −29.3 | 4.60 ± 0.28 |
| Mineral + bio, 10% by weight | 10.8 ± 0.3 | −26.9 | 10.04 ± 0.29 |

Example 9

Carbon Number Distribution

The proportion of the narrow carbon number distribution of the base oil product is dependent on distillation. In FIG. 1 the carbon number distributions of VHVI (413-520° C. cut) and the baseoils of the invention (360° C. cut) are shown. The carbon number distribution of the base oils according to invention is narrower than that of conventional base oils when distillation is cut in similar manner at >413° C. corresponding to C26 paraffins. The baseoils of the invention contain higher amount of higher boiling fractions compared to the conventional product of same viscosity range (KV100 about 4 cSt), as shown in FIG. 1 with carbon number distributions. The lower boiling components with carbon number <C31 are due to cracking in isomerization. The higher boiling compounds enhance VI.

The invention claimed is:

1. A base oil comprising branched saturated hydrocarbons having carbon numbers from C18 to C36, the base oil comprising at least 90% by weight of saturated hydrocarbons, less than 10% by weight of linear paraffins, not more than 0.1% by FIMS of fused polynaphthenes, 5-50% by FIMS of mononaphthenes, and at least 50% by weight of the saturated hydrocarbons have a width of the carbon number range of no more than 7 carbons, wherein the base oil has a kinematic viscosity at 100° C. of 3 to 8 cSt, a CCS-30 viscosity of no more than $34.066*(KV100)^{2.3967}$ and a CCS-35 viscosity of no more than $50.501*(KV100)^{2.4918}$ cP, and which base oil is derived from starting material of plant biological origin.

2. The base oil according to claim 1, wherein at least 75% by weight of the saturated hydrocarbons have a width of the carbon number range of no more than 7 carbons.

3. The base oil according to claim 1, wherein the base oil comprises at least 95% by weight of saturated hydrocarbons.

4. The base oil according to claim 1, wherein the base oil comprises less than 5% by weight of linear paraffins.

5. The base oil according to claim 1, wherein the base oil comprises 5-30% by FIMS of mononaphthenes.

6. The base oil according to claim 1, wherein the base oil complies with the requirements for base oils according to the classification of the API Group II+.

7. The base oil according to claim 1, wherein a pour point of said base oil being not over −9° C.

8. The base oil according to claim 1, wherein the viscosity index of said base oil is higher than 115.

9. The base oil according to claim 1, wherein the volatility of the base oil is not more than $2271.2*(KV100)^{-3.5373}$% by weight.

10. The base oil according to claim 1, wherein the base oil comprises less than 10% by weight of aromatic carbon.

11. The base oil according to claim 1, wherein the sulfur content thereof is less than 300 ppm.

12. The base oil according to claim 1, wherein the nitrogen content thereof is less than 100 ppm.

13. The base oil according to claim 1, wherein the distillation range of said base oil is no more than 150° C. (distillation points D10 and D90).

14. The base oil according to claim 1, wherein the width of the carbon number range thereof is no more than 5 carbons.

15. The base oil according to claim 1, wherein the base oil comprises less than 1% by weight of linear paraffins.

16. The base oil according to claim 1, wherein the base oil comprises 5-15% by FIMS of mononaphthenes.

17. The base oil according to claim 1, wherein the base oil complies with the requirements for base oils according to the classification of the API Group III.

18. The base oil according to claim 1, wherein a pour point of said base oil being not over −12° C.

19. The base oil according to claim 1, wherein a pour point of said base oil being not over −15° C.

20. The base oil according to claim 1, wherein the viscosity index of said base oil is higher than 130.

21. The base oil according to claim 1, wherein the viscosity index of said base oil is higher than 150.

22. The base oil according to claim 1, wherein the base oil comprises less than 5% by weight of aromatic carbon.

23. The base oil according to claim 1, wherein the sulfur content thereof is less than 50 ppm.

24. The base oil according to claim 1, wherein the sulfur content thereof is less than 1 ppm.

25. The base oil according to claim 1, wherein the nitrogen content thereof is less than 10 ppm.

26. The base oil according to claim 1, wherein the distillation range of said base oil is no more than 100° C. (distillation points D10 and D90).

27. A base oil comprising branched saturated hydrocarbons having carbon numbers of at least C18, the $^{14}C$ isotope content of the total carbon content in the base oil is at least 50%, on the basis of radioactive carbon content in the atmosphere in the year 1950 according to ASTM D 6866, the base oil comprising at least 90% by weight of saturated hydrocarbons, less than 10% by weight of linear paraffins, not more than 0.1% by FIMS of fused polynaphthenes, 5-50% by FIMS of mononaphthenes, and at least 50% by weight of the saturated hydrocarbons have a width of the carbon number range of no more than 7 carbons, wherein the base oil has a kinematic viscosity at 100° C. of 3 to 8 cSt, a CCS-30 viscosity of no more than $34.066*(KV100)^{2.3967}$ and a CCS-35 viscosity of no more than $50.501*(KV100)^{2.4918}$ cP.

* * * * *